US010763623B2

(12) United States Patent
Eisfeld

(10) Patent No.: US 10,763,623 B2
(45) Date of Patent: Sep. 1, 2020

(54) PRINTED CIRCUIT BOARD CONNECTOR HAVING A SHIELDING ELEMENT

(71) Applicant: HARTING Electronics GmbH, Espelkamp (DE)

(72) Inventor: Kathrin Eisfeld, Lemförde (DE)

(73) Assignee: HARTING Electronics GmbH, Espelkamp (DE)

( * ) Notice: Subject to any disclaimer, the term of this patent is extended or adjusted under 35 U.S.C. 154(b) by 0 days.

(21) Appl. No.: 16/645,006

(22) PCT Filed: Sep. 18, 2018

(86) PCT No.: PCT/DE2018/100791
§ 371 (c)(1),
(2) Date: Mar. 6, 2020

(87) PCT Pub. No.: WO2019/072336
PCT Pub. Date: Apr. 18, 2019

(65) Prior Publication Data

US 2020/0235527 A1 Jul. 23, 2020

(30) Foreign Application Priority Data

Oct. 10, 2017 (DE) ..... 10 2017 123 539

(51) Int. Cl.
*H01R 13/6581* (2011.01)
*H01R 12/71* (2011.01)
(Continued)

(52) U.S. Cl.
CPC ..... *H01R 13/6581* (2013.01); *H01R 12/716* (2013.01); *H01R 13/405* (2013.01); *H01R 13/50* (2013.01); *H01R 43/205* (2013.01)

(58) Field of Classification Search
CPC ..... H01R 12/706; H01R 13/6585; H01R 13/6581; H01R 13/6589
(Continued)

(56) References Cited

U.S. PATENT DOCUMENTS 4,598,961 A * 7/1986 Cohen ..... H01R 24/50 439/581
4,936,795 A * 6/1990 Kawai ..... H01R 13/655 439/607.19
(Continued)

FOREIGN PATENT DOCUMENTS

DE 102010051954 2/2012
DE 102012105256 A1 12/2013
(Continued)

*Primary Examiner* — Peter G Leigh
(74) *Attorney, Agent, or Firm* — Smartpat PLC

(57) ABSTRACT

An arrangement of an annular shielding element (1) comprises inwardly and outwardly pointing tabs (11, 12) on an insulating body (2) of a printed circuit board connector, for improving the electrical conductivity of both the earth connection between a plug connector housing (4)/device housing and a cruciform shield (31) of the insulating body (2)/a printed circuit board (5) associated therewith. The shielding element (1) can be designed as a stamped and bent part and can be formed from a resilient metal sheet. The invention significantly reduces the amount of force required to plug on the plug connector housing (4). This is very important in particular when constructing electrical devices because, here, printed circuit boards (5) comprise a plurality of mounted insulating bodies (2) which are simultaneously inserted into the plug connector housing (4) of a housing wall (6) of the device housing.

9 Claims, 5 Drawing Sheets

(51) Int. Cl.
*H01R 43/20* (2006.01)
*H01R 13/405* (2006.01)
*H01R 13/50* (2006.01)

(58) Field of Classification Search
USPC ..... 439/78
See application file for complete search history.

(56) References Cited

U.S. PATENT DOCUMENTS 4,938,714 A * 7/1990 Kawai ..... H01R 13/6582 439/607.01
5,017,158 A * 5/1991 Liu ..... H01R 13/506 439/607.23
5,029,908 A 7/1991 Belisaire
6,494,743 B1 * 12/2002 Lamatsch ..... H01R 13/6586 439/607.05
8,147,272 B2 * 4/2012 Rhein ..... H01R 13/5202 439/556
8,591,268 B2 * 11/2013 Reimchen ..... H01R 13/6473 439/701
8,926,366 B2 * 1/2015 Dang ..... H01R 13/6585 439/607.05
9,184,544 B2 * 11/2015 Sasano ..... H01R 13/6595
9,306,312 B2 * 4/2016 Dang ..... H01R 13/6586
9,306,338 B2 * 4/2016 Dang ..... H01R 13/6585
9,362,679 B2 * 6/2016 Schreier ..... H01R 13/035
9,502,796 B2 * 11/2016 Genau ..... H01R 12/724
9,502,828 B2 * 11/2016 Schreier ..... H01R 12/72
9,543,709 B2 * 1/2017 Schreier ..... H01R 13/6585
9,615,491 B2 * 4/2017 Schreier ..... H01R 13/035
2006/0125235 A1 6/2006 Andre
2013/0137310 A1 5/2013 Genau
2015/0325956 A1 11/2015 Schreier et al.

FOREIGN PATENT DOCUMENTS

EP 3048675 A1 7/2016
FR 2921522 A1 3/2009

* cited by examiner

PRINTED CIRCUIT BOARD CONNECTOR HAVING A SHIELDING ELEMENT

TECHNICAL FIELD

The disclosure relates to a printed circuit board connector having a shielding element, as is required for the mutual electrical connection of a metallic housing and a cruciform shield of the printed circuit board connector, and to a method for assembling such a printed circuit board connector.

BACKGROUND

Printed publication DE 10 2010 051 954 B3 discloses a circular connector which is configured, on the terminal side, for contact connection on a printed circuit board. For the transmission of a plurality of independent differential signals, electrical contacts are arranged in pairs in the connector.

For the damping of crosstalk between the signal pairs, an electrically conductive cruciform shield is provided, which is connected to at least one ground terminal of the printed circuit board in an electrically conductive manner. This is enclosed by a likewise cruciform contact carrier, in the obliquely configured inner edges of which locating grooves are provided for the accommodation of electrical contacts. The electrically non-conductive circular body is push-fitted over this cruciform arrangement and, in turn, is ultimately enclosed by an electrically conductive connector housing.

It is further disclosed that the insulating circular body, approximately midway along its length, incorporates a circumferential groove, in which an annular and electrically conductive helical spring is inserted. This can be electrically contact connected, firstly with the cruciform shield at the latching moldings thereof, by means of two mutually opposing longitudinal slots in the circular body. Secondly, the helical spring can be contact connected with the electrically shielding connector housing which encloses the circular body. The connector housing can be incorporated in an electrically conductive device housing in the form of a front panel insert, and is connectable, on the plug-in side, with a mating connector which is inserted from the exterior.

In practice, however, it has emerged that the shielding connection by means of the above-mentioned helical spring, upon the plugging-in of the electrically conductive connector housing, generates relatively high assembly forces. Moreover, the conductive behavior of the helical spring, on the grounds of the relatively small electrical contact surface vis-à-vis the connector housing and the cruciform shield, is not ideal. The structural necessity for a circumferential annular groove can also adversely affect stability and the available space for other structural features in the circular body.

By way of an improvement, printed publication DE 10 2012 105 256 A1 proposes the employment of an open spring washer. The spring washer has an appropriate outline for the electrical contact connection, firstly of the cruciform shield and secondly of a connector housing in which the insulating body is inserted, and thus for the electrically conductive connection thereof.

However, the use of a spring washer of this type is associated with a disadvantage, in that a groove is also required in the circular body for this purpose. This can be configured to a somewhat narrower width than in the case of the above-mentioned helical spring configuration, and is not required to run entirely around the insulating body. It has further emerged that, even in this configuration, the force associated with the plugging-in of the connector housing is not optimally transposed, as the spring washer also assumes a somewhat inclined and potentially tilted position, rather than, as required, extending exclusively towards the interior, in order to constitute the electrical contact with the cruciform shield. The effective contact surface thereof, vis-à-vis both the housing and the cruciform shield, at the corresponding contact points, is also somewhat small, which impacts negatively upon the electrical conductivity of this shielding connection.

The German Patent and Trademark Office, in the priority application with respect to the present application, has investigated the following prior art: U.S. Pat. Nos. 5,029,908 A, 4,938,714 A and US 2006/0125235 A1.

SUMMARY

The object of the disclosure is to provide an easily-assembled and good electrically conductive shielding connection between the electrically conductive connector housing and the cruciform shield which, moreover, can be produced as cost-effectively as possible.

This object is achieved by the printed circuit board connector as claimed.

A printed circuit board connector comprises at least the following:

An insulating body having an essentially cylindrical plug-in region, which is subdivided into four segments by a plurality of slots which are oriented in the plug-in direction, wherein each of the segments comprises at least one through-opening for the insertion of one electrical socket contact respectively, wherein the insulating body, at the plug-in region, then has a likewise essentially cylindrical connection region, wherein the connection region assumes a larger diameter than the plug-in region, as a result of which a circumferential shoulder is constituted between the plug-in region and the connection region;

a plurality of socket contacts arranged in the through-openings, which pass through the connection region of the insulating body for the purposes of electrical contact connection with terminals on the printed circuit board, a cruciform shield accommodated in the insulating body, an electrically conductive connector housing, together with the above-mentioned shielding element for the contact connection of the connector housing with the cruciform shield, wherein the shielding element is at least partially constituted of an electrically conductive material, wherein the shielding element comprises a closed ring, on which both inwardly and outwardly pointing spring-elastic tabs are integrally molded, wherein the shielding element, with its ring, is arranged on the circumferential shoulder of the insulating body, the inwardly pointing tabs thereof engage in the slots such that, firstly, the cruciform shield is electrically contact-connected, and the outwardly pointing tabs thereof project beyond the connection region and/or are bent around the connection region such that, secondly, the connector housing is electrically contact-connected.

The latter is particularly advantageous on the grounds that the shielding element, in this manner, constitutes a large-area electrically conductive connection, thus having a particularly good electrical conductivity, between the connector housing and the cruciform shield.

This arrangement further provides an advantage, in that it can be easily assembled. The shielding element cannot be skewed during assembly. The housing can be plugged onto the connector with only a limited force. The shielding connection has very good electrical conductivity, both vis-à-vis the connector housing and vis-à-vis the cruciform shield. In other words, the shielding element, in both directions, has only a slight ohmic contact resistance, as the tabs, on the grounds of their shape and elasticity, firstly assume a large-area contact with the cruciform shield and secondly assume a large-area contact with the connector housing, and are elastically connected thereto.

Advantageous configurations of the invention are disclosed in the dependent claims.

In one advantageous configuration, the shielding element comprises at least two, preferably at least three, and specifically four inwardly pointing spring-elastic tabs for the electrical contact connection of the cruciform shield. This is highly appropriate, firstly on the grounds of the stipulated shape of the cruciform shield and the insulating body. Secondly, a multiple ground connection of this type is particularly advantageous for high-frequency applications.

In further preferred configurations, the shielding element can comprise two or three, or at least four, i.e. four, five, six, seven, eight or even more than eight outwardly pointing spring-elastic tabs for the contact connection of the connector housing.

In a preferred configuration, the shielding element comprises four outwardly pointing tabs. The high number of outwardly pointing tabs, e.g. preferably four, is also advantageous for the discharging of high-frequency interference signals.

This discharging of high-frequency interference signals is executed particularly effectively, if the inwardly pointing tabs and/or the outwardly pointing tabs are respectively arranged with equidistant spacings on the ring.

A particularly advantageous effect upon conductivity, specifically for the above-mentioned discharging of high-frequency electrical signals, is achieved if the entire shielding element is constituted of an electrically conductive material.

In a particularly preferred configuration, the shielding element is constituted from a sheet metal arranged in the annular plane, and is preferably stamped therefrom. Specifically, the shielding element can be a stamped and bent part. The sheet metal is advantageously electrically conductive. The sheet metal specifically possesses spring-elastic properties.

A printed circuit board connector of this type can be manufactured as follows:

- Insertion of the cruciform shield and the socket contacts in the insulating body, and fastening of the cruciform shield and the socket contacts in the insulating body;
- Fastening of the insulating body, with the cruciform shield, on/onto the printed circuit board, and the electrically conductive connection of the cruciform shield to at least one ground terminal of the printed circuit board, together with the electrical contact connection of the socket contacts inserted in the insulating body to corresponding terminals on the printed circuit board,
- Mating-side plugging of the shielding element onto the insulating body and arrangement of the ring of the shielding element on the shoulder between the plug-in region and the connection region;
- Contact connection of the cruciform shield with the inwardly pointing tabs of the shielding element, by the insertion thereof in the slots of the insulating body;
- Plugging of the electrically conductive connector housing onto the insulating body, and constitution of an electrically conductive connection between the connector housing and the cruciform shield by electrical contact connection of the connector housing with the outwardly pointing tabs of the shielding element.

By the term "mating-side plugging", it is to be understood that the shielding element is plugged onto the insulating body at the plug-in region.

This assembly method is particularly easy to execute. Specifically, the connector housing can be plugged onto the insulating body with only a limited force. In practice, e.g. in device construction engineering, this is of considerable significance. Finally, it is frequently the case that a printed circuit board having a plurality of connectors is installed in a device housing. Specifically, an entire row of insulating bodies can be fitted, e.g. to one edge of a printed circuit board and inserted, in combination with said printed circuit board, into a connector housing which is previously incorporated in a front side of a device housing.

In another configuration, an entire array of mounted insulating bodies can also be distributed over the surface of the printed circuit board and inserted, in combination with the latter, into the associated connector housing, arranged e.g. in an upper side of the device housing. Corresponding assembly forces are thus totalized, such that the printed circuit board, in the event of a higher number e.g. of at least two, three, four, five, six, seven, or even eight or even more connectors, e.g. nine, ten, eleven, twelve, thirteen, fourteen, fifteen or at least sixteen connectors, is exposed to correspondingly high forces and mechanical stresses during this insertion process. The complexity of manual assembly is also relatively high as a result.

By the minimization of individual forces associated with the plugging of each individual connector housing onto the individual insulating bodies, ultimately, the entire assembly force is also correspondingly reduced, thereby simplifying assembly.

The printed circuit board is further protected from correspondingly high mechanical stresses in the assembly process.

Moreover, the increase in the conductivity of the ground connection of each individual connector housing is also associated with an improvement in the ground connection of the device housing, to which the individual connector housings, by the installation thereof, are connected in a preferably electrically conductive manner. Conversely, by means of the plurality of connectors, a good conductive ground connection of the printed circuit board can of course also be provided, if the device housing, for example by means of a ground contact, e.g. a grounding screw, is externally grounded, e.g. via its electric power supply.

BRIEF DESCRIPTION OF THE DRAWINGS

An exemplary embodiment of the invention is represented in the drawings and described in greater detail hereinafter.

DETAILED DESCRIPTION

The figures contain partially simplified and schematic representations. In some cases, identical reference numbers are employed for equivalent, but optionally not identical elements. Different views of the same elements could be scaled differently.

Figure 1A:
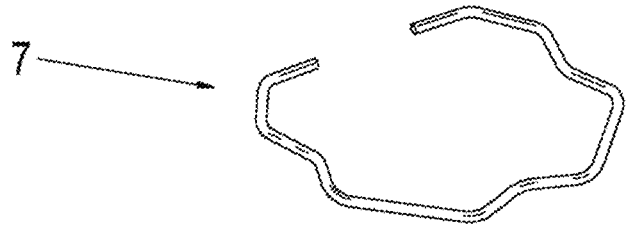
FIG. 1*a* shows an open spring washer according to the prior art.

FIG. 1*a* shows an open spring washer 7 according to the prior art. The outline thereof, in the form of a meander-shaped open ring, can be clearly seen.

Figure 1B:
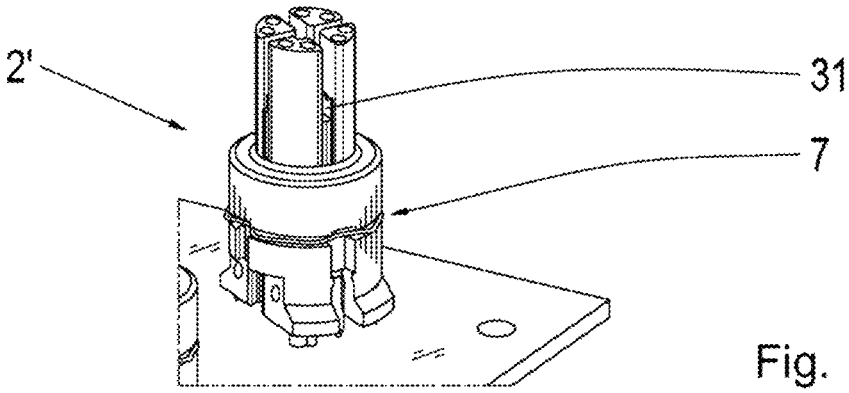
FIG. 1*b* shows an insulating body with the open spring washer.

FIG. 1*b* shows an insulating body 2' in a first form of embodiment, in which the insulating body 2' incorporates a substantially circumferential groove, which is not identified more closely. The spring washer 7 is arranged in this groove. As a result of its meander shape, the spring washer 7, in sections, projects beyond the insulating body 2' and engages, in sections, in the terminal-side slots thereof, in order to establish an electrical contact connection with the cruciform shield 31 which is arranged in the insulating body 2'. The regions of the spring washer 7 which project beyond the insulating body 2' can be contact connected by means of a metallic connector housing 4 which is plugged onto the insulating body 2'. At the same time, the open spring washer 7, by the action of the connector housing 4, can undergo elastic strain, and is thus inwardly compressed against the cruciform shield 31 with increased pressure.

Figure 1C:
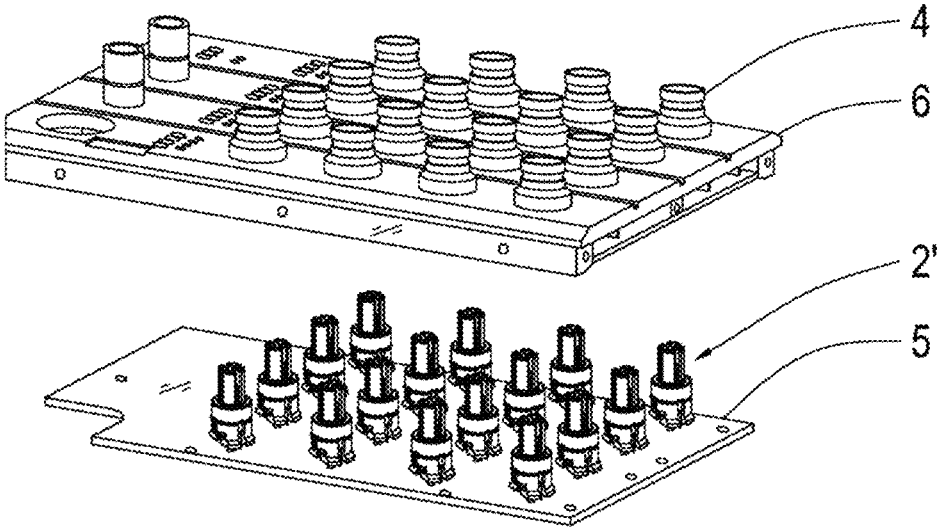
Prior art Fig. 1c
FIG. 1*c* shows a housing wall with connector housings, and a printed circuit board with insulating bodies fitted thereupon.

FIG. 1*c* shows a printed circuit board 5 having a plurality of insulating bodies 2' fitted thereupon, populated with the cruciform shield 31 and socket contacts, which are not represented here, which are designed to be inserted into the associated connector housings 4. To this end, said connector housings 4 are appropriately mounted on a separately represented housing wall 6 of a device housing. The connector housings 4 are respectively comprised of an electrically conductive material, and are connected, in an electrically conductive manner, to the likewise electrically conductive device housing/electrically conductive housing wall 6. By means of the electrical contact with the ground terminals of the printed circuit board 5 which is established, upon plugging-in, via the spring washer 7 and the cruciform shield 31, an electrically conductive connection between the printed circuit board 5 and the device housing is also ensured accordingly. At the same time, for the compensation of tolerances, an element of play is provided between the printed circuit board 5 and the housing wall 6.

It is easily conceivable that, according to the state of the art represented, a substantial expenditure of force is required to simultaneously plug the plurality of connector housings 4 onto the insulating bodies 2' via the associated spring washers 7. Ultimately, one or more of the spring washers 7 can be slightly rotated in the plug-in direction, and skewed as a result. Moreover, the electrically effective contact surface between the respective connector housing 4 and the associated spring washer 7, and the electrically effective contact surface between the spring washer 7 and the cruciform shield 31, is only very small. As a result, the ground connection between the connector housing 4/housing wall 6 on the one hand, and the cruciform shield 31/printed circuit board 5 on the other, is not ideal.

Figure 2A:
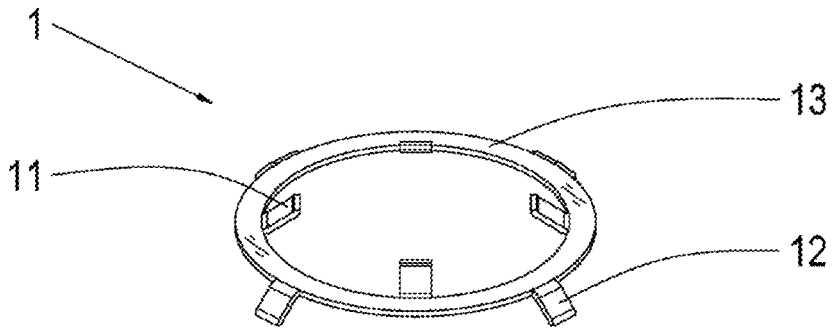
FIG. 2*a* shows a shielding element.

FIG. 2*a* shows a spring element 1. It comprises a ring 13, on which four inwardly pointing tabs 11 and four outwardly pointing tabs 12 are integrally molded. The shielding element 1 is configured as a stamped and bent part, i.e. it can be constituted, for example, of an electrically conductive spring-elastic sheet metal, e.g. by stamping, which is arranged in the annular plane.

Figure 2B:
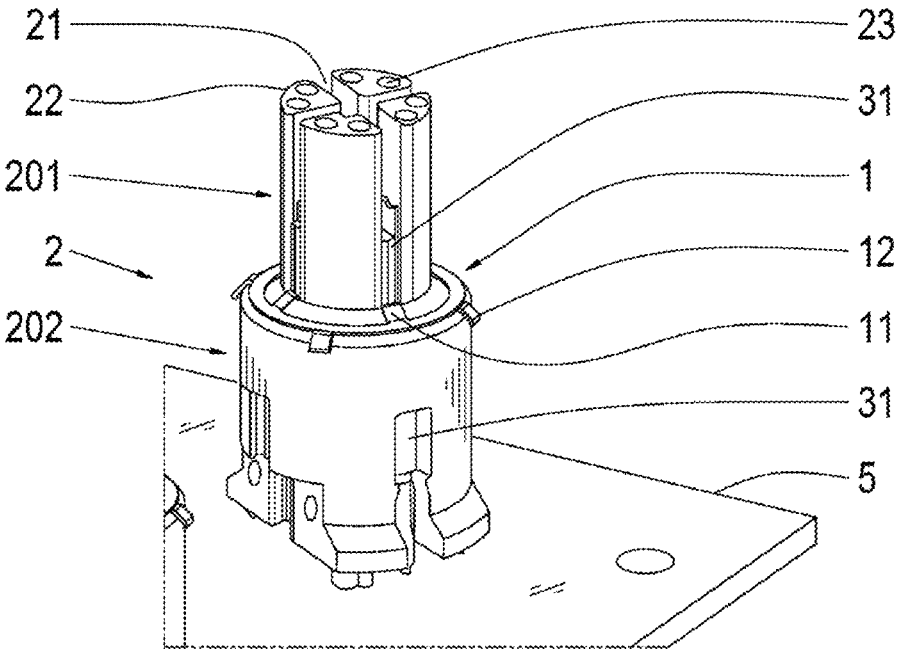
FIG. 2*b* shows an insulating body with the shielding element.

FIG. 2*b* shows an associated insulating body 2, which is populated with the cruciform shield 31 and socket contacts 33, which are not visible in this representation, and is fitted to a printed circuit board 5.

The insulating body 2, on the terminal side, comprises an essentially cylindrical connection region 202. Arranged in opposition, it comprises a likewise essentially cylindrical plug-in region 201, the diameter of which is smaller than the diameter of the connection region 202. As a result, at the transition from the plug-in region 201 to the connection region 202, a circumferential shoulder 203 is constituted which, in the interests of clarity, is not shown in this representation.

The connection region 202 is divided, by two slots 21 in a cruciform arrangement, into four identically shaped segments 22, each of which comprises two through-openings 23 for the accommodation of one socket contact pair per segment 22, wherein the through-openings 23 pass through the entire insulating body 2.

The cruciform shield 31 is fitted to the printed circuit board 5 on the terminal side, and is connected to at least one ground terminal of the printed circuit board 5 in an electrically conductive manner. The cruciform shield 31 passes through the connection region 202 to the plug-in region 201 of the insulating body 2, where it engages in the cruciform slots 21 thereof. The insulating body 2 further also comprises, on the terminal side, two mutually opposing and slot-like openings, which are not identified more closely, of which one is visible in the drawing, and through which a terminal-side region of the cruciform shield 31 can clearly be seen.

The shielding element 1 is plugged onto the insulating body 2 by means of the plug-in region 201, such that the ring 13 of the shielding element 1 is arranged on the shoulder 203 of the insulating body 2. To this end, the ring 13 possesses an external diameter which is smaller than the diameter of the connection region 202, and an internal diameter which is greater than the diameter of the plug-in region 201.

The inwardly pointing tabs 11 of the shielding element 1 engage in the cruciform slots 21 of the insulating body 2, for the contact connection of the cruciform shield 31. The outwardly pointing tabs 12 of the shielding element project beyond the connection region 202 of the insulating body 2, for the contact connection of the connector housing 4, which is not represented here.

Figure 3A:
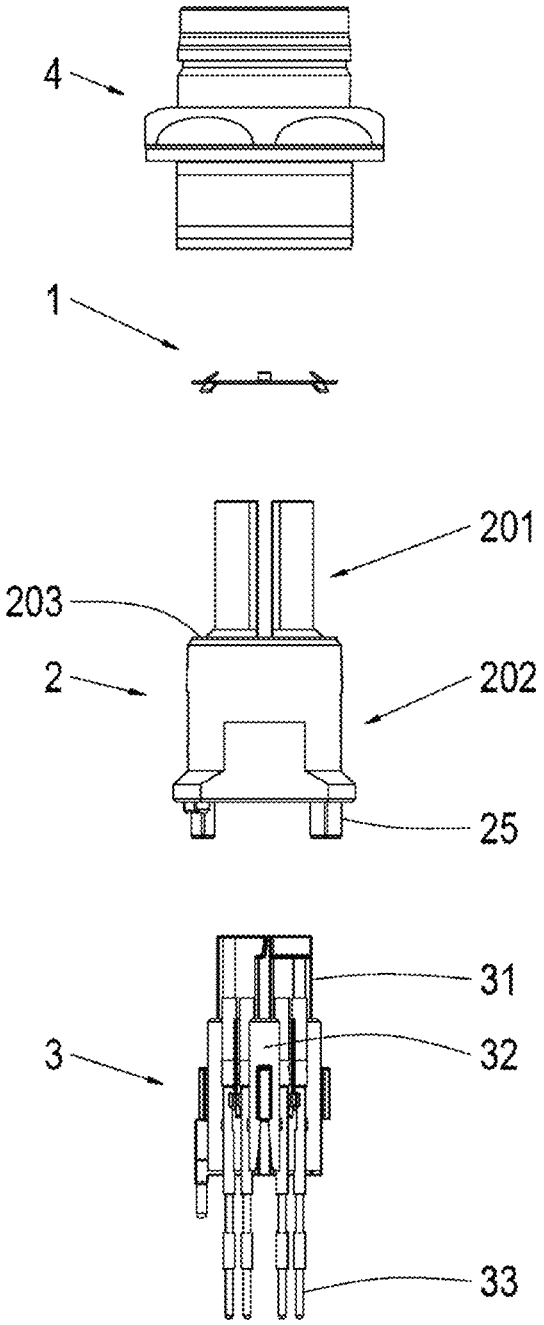
FIG. 3*a, b* show an unassembled connector in a side view and in a 3D representation.
Figure 3B:
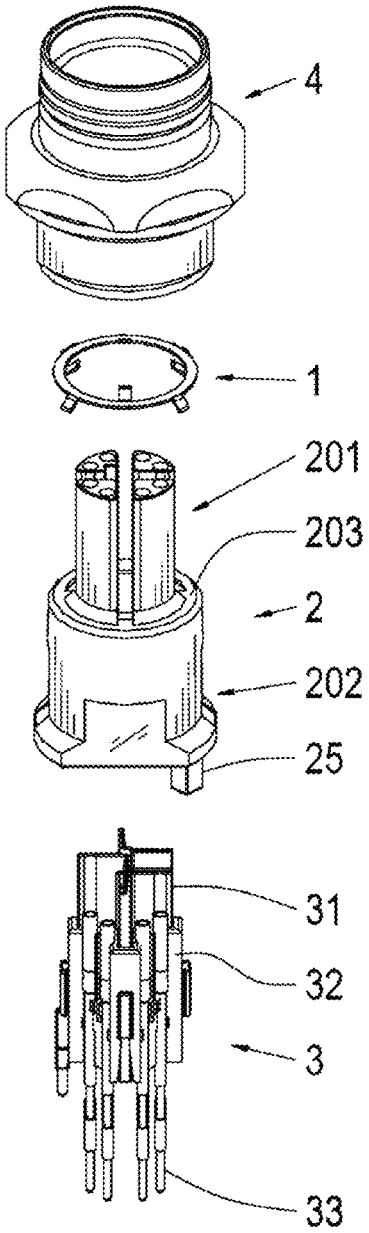

FIGS. 3*a* and 3*b* show the, as yet, unassembled connector in a side view and in a 3D representation. The connector comprises the above-mentioned connector housing 4, the shielding element 1, the insulating body 2 and a combined cruciform shield/contact arrangement 3.

In this representation, the plug-in region 201, the connection region 202 and the shoulder 203 of the insulating body 2 are identified by reference numbers. A locating pin 25 is further also identified at the end of the connection region 202. The function of the latter is the location of the insulating body 2 on the printed circuit board 5.

The combined cruciform shield/contact arrangement 3 comprises the cruciform shield 31, a contact carrier 32 which is fastened thereto, and eight socket contacts 33 which are fitted thereupon, of which, in the drawing, only four are visible, as the others are optically concealed by the visible socket contacts 33. In the interests of clarity, the socket contacts 33, in this representation, are shown in the contact carrier 32 with a converse displacement to the plug-in direction, in relation to their assembled state. In the assembled state, they are designed to project beyond the cruciform shield 31 in the plug-in direction and, further to the insertion thereof in the insulating body 2, to terminate virtually flush to the through-openings 23.

Figure 4A:
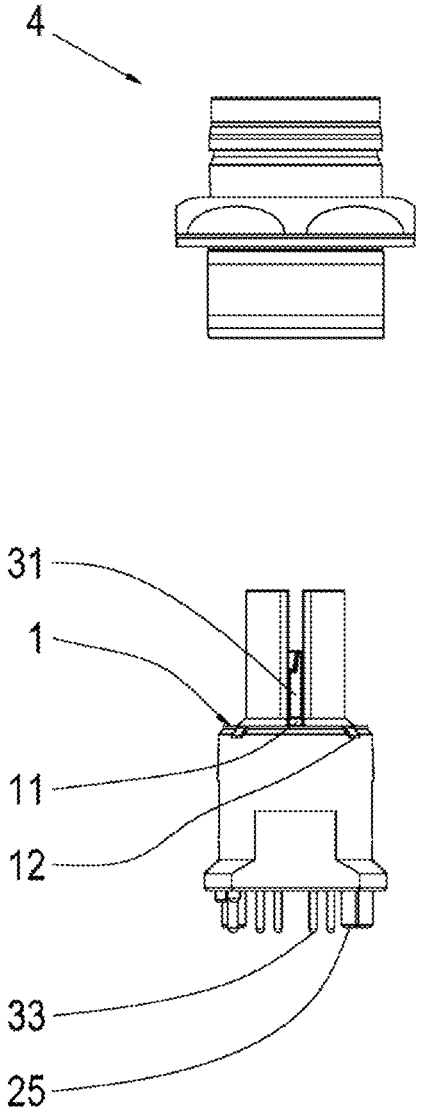
FIG. 4*a, b* show the assembled connector, with a separate connector housing, in a side view and in a 3D representation.
Figure 4B:
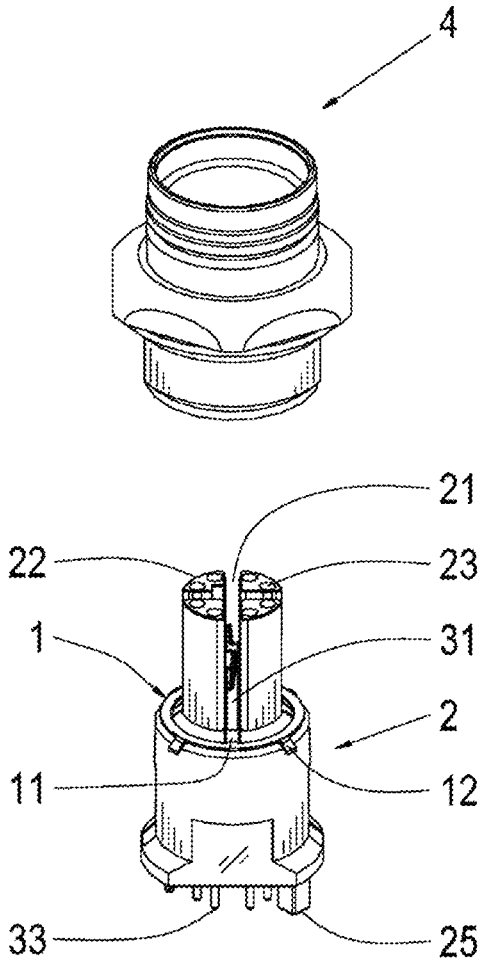

FIGS. 4*a* and 4*b* show the substantially assembled connector, with the separate connector housing 4, in a side view and in a 3D representation. The combined cruciform shield/contact arrangement 3 is inserted in the insulating body 2. The connector housing 4 is represented in a suspended position above the plug-in region 201 of the insulating body 2. The shielding element 1, on the plug-in side, is plugged onto the insulating body 2. The inwardly pointing tabs 11 thereof engage in the slots 21 of the insulating body 2. The outwardly pointing tabs 12 project beyond the connection region 202 of the insulating body 2. The ring 13 is arranged on the shoulder 203.

Upon the plugging-in of the electrically conductive connector housing 4, the latter is contact connected, with only a limited force and a relatively large common contact surface, with the outwardly pointing tabs 12 of the shielding element 1. Ultimately, the outwardly pointing tabs 12, on the grounds of their spring-elastic properties, are capable, upon the plugging-in of the connector housing 4, of bending around the connection region 202 of the insulating body 2 such that, firstly, the expenditure of force required for this purpose is reduced and, secondly, a particularly large and electrically conductive common contact surface is constituted with the connector housing 4. The inwardly pointing tabs 11 of the shielding element 1 also execute the contact connection of the cruciform shield 31 over a relatively large electrically conductive contact surface, and are connected to the latter.

Figure 5A:
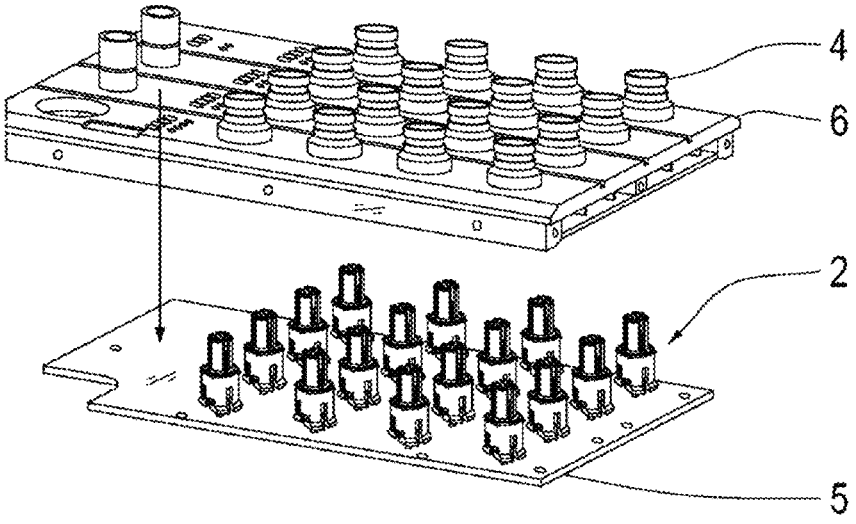
FIG. 5*a* shows the housing wall with the connector housings, and the printed circuit board with the insulating bodies fitted thereupon.

FIG. 5*a* shows a representation which is comparable to FIG. 1*c*, wherein the printed circuit board 5, in this case, is provided with insulating bodies 2 which comprise shielding elements 1.

Figure 5B:
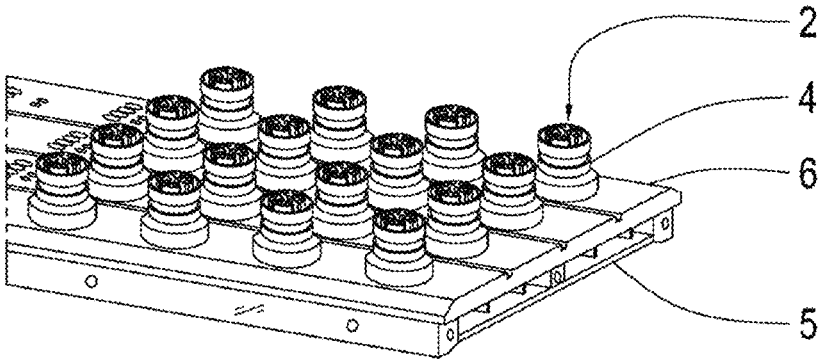
FIG. 5*b* shows the printed circuit board connected to the housing wall.

From the preceding representation, it is clear that the printed circuit board 5 can now be attached to the housing wall 6 with a significantly reduced expenditure of force and a significantly improved conductivity of the common ground connection, wherein the insulating bodies 2 are immersed in the connector housings 4, as represented in FIG. 5*b*.

Although, in the figures, various aspects or characteristics of the invention are respectively represented in combination, it will be evident to a person skilled in the art—unless indicated otherwise—that the combinations represented and discussed are not the only combinations possible. Specifically, mutually corresponding units or series of characteristics from different exemplary embodiments can be mutually interchanged.

LIST OF REFERENCE NUMBERS

1 Shielding element
11 Inwardly pointing tabs
12 Outwardly pointing tabs
13 Ring
2, 2' Insulating body
201 Plug-in region
202 Connection region
203 Shoulder
21 Cruciform arrangement of slots
22 Segments
23 Through-openings
25 Locating pin
3 Combined cruciform shield/contact arrangement
31 Cruciform shield
32 Contact carrier
33 Socket contacts
4 Connector housing
5 Printed circuit board
6 Housing wall of an electrical device
7 Open spring washer

The invention claimed is:

1. A printed circuit board connector, comprising:

an insulating body (2) having an essentially cylindrical plug-in region (201), wherein the plug-in region (201) is subdivided into four segments (22) by a plurality of slots (21) which are oriented in a plug-in direction, wherein each of the four segments (22) comprises at least one through-opening (23) for inserting an electrical socket contact (33), wherein an essentially cylindrical connection region (202) is arranged in extension of the plug-in region (201), and wherein the connection region (202) has a larger diameter than the plug-in region (201), as a result of which a circumferential shoulder (203) is formed between the plug-in region (201) and the connection region (202);

a plurality of socket contacts (33) arranged in the through-openings (23), which pass through the connection region (202) of the insulating body (2) and electrically contact terminals on a printed circuit board (5);

a cruciform shield (31) accommodated in the insulating body (2);

an electrically conductive connector housing (4); and a shielding element (1), wherein the shielding element (1) provides a contact connection between the connector housing (4) and the cruciform shield (31), wherein the shielding element (1) is at least partially made of an electrically conductive material, wherein the shielding element (1) comprises a closed ring (13), on which both inwardly and outwardly pointing spring-elastic tabs (11, 12) are integrally formed, wherein the shielding element (1), with its ring (13), is arranged on the circumferential shoulder (203) of the insulating body (2), wherein the inwardly pointing tabs (11) engage in the slots (21) such that the cruciform shield (31) is electrically contact-connected, and wherein the outwardly pointing tabs (12) project beyond the connection region (202) and/or are bent around the connection region (202) such that the connector housing (4) is electrically contact-connected.

2. The printed circuit board connector as claimed in claim 1, wherein the shielding element (1) comprises four inwardly pointing spring-elastic tabs (11) for the electrical contact connection of the cruciform shield (31).

3. The printed circuit board connector as claimed in claim 1, wherein the shielding element (1) comprises at least four outwardly pointing spring-elastic tabs (12) for the contact connection of the connector housing (4).

4. The printed circuit board connector as claimed in claim 1, wherein the inwardly pointing tabs (11) and/or the outwardly pointing tabs (12) of the shielding element (1) are respectively arranged with equidistant spacings on the ring (13) thereof.

5. The printed circuit board connector as claimed in claim 1, wherein the shielding element (1) is made entirely of an electrically conductive material.

6. The printed circuit board connector as claimed in claim 1, wherein the shielding element (1) is made from a sheet metal arranged in an annular plane.

7. The printed circuit board connector as claimed in claim 1, wherein the shielding element (1) is stamped from sheet metal.

8. The printed circuit board connector as claimed in claim 1, wherein the shielding element (1) is a stamped and bent part.

9. A method for assembling a printed circuit board connector, comprising:

providing the printed circuit board connector as claimed in claim 1;

inserting the cruciform shield (31) and the socket contacts (33) in the insulating body (2), and fastening the cruciform shield (31) and the socket contacts (33) in the insulating body (2);

fastening the insulating body (2), with the cruciform shield (31), on or onto the printed circuit board (5), and the electrically conductively connecting the cruciform shield (31) to at least one ground terminal of the printed circuit board (5), and establishing an electrical contact connection of the socket contacts (33) inserted in the insulating body (2) to corresponding terminals on the printed circuit board (5);

placing the shielding element (1) from a plug-in side onto the insulating body (2) and arranging the ring (13) of the shielding element (1) on the shoulder (203) between the plug-in region (201) and the connection region (202);

establishing a contact connection of the cruciform shield (31) with the inwardly pointing tabs (11) of the shielding element (1), by the insertion thereof in the slots (21) of the insulating body (2); and placing the electrically conductive connector housing (4) onto the insulating body (2), and establishing an electrically conductive connection between the connector housing (4) and the cruciform shield (31) by electrical contact connection of the connector housing (4) with the outwardly pointing tabs (12) of the shielding element (1).

* * * * *